United States Patent [19]

Tuisl

[11] Patent Number: 4,580,298

[45] Date of Patent: Apr. 8, 1986

[54] WAIST BAND EXTENDER

[76] Inventor: Richard M. Tuisl, 5516 N. Bernard, Chicago, Ill. 60625

[21] Appl. No.: 739,964

[22] Filed: May 31, 1985

Related U.S. Application Data

[63] Continuation of Ser. No. 547,202, Oct. 31, 1983, abandoned.

[51] Int. Cl.[4] ..... A41F 9/02

[52] U.S. Cl. ..... 2/237; 2/76; 2/141 R; 2/220; 2/236; 2/338

[58] Field of Search ..... 2/237, 236, 220, 221, 2/76, 219, 235, 234, 218, 338, 141 R, 141 A; 24/379

[56] References Cited

U.S. PATENT DOCUMENTS

| | | | |
|---|---|---|---|
| 1,233,057 | 7/1917 | Hoehn | 2/76 |
| 1,291,048 | 1/1919 | McKevitt et al. | 2/76 |
| 1,365,749 | 1/1921 | Torchia | 2/76 |
| 1,421,690 | 7/1922 | Howard | 2/338 |
| 2,544,333 | 2/1948 | Lembo | 2/221 |
| 2,585,689 | 2/1952 | Schafer | 24/379 |
| 2,656,579 | 10/1953 | Wilson | 2/218 |
| 2,675,559 | 4/1954 | Miller | 2/234 |
| 2,821,716 | 2/1958 | Salter | 2/141 A |
| 3,106,719 | 10/1963 | Rosenfeld | 2/141 R |
| 3,255,503 | 6/1966 | Sozzi | 2/234 |
| 3,271,832 | 9/1966 | Yankers | 2/234 |
| 3,276,086 | 10/1966 | Reese | 2/234 |
| 4,164,044 | 8/1979 | Holmes | 2/237 |

FOREIGN PATENT DOCUMENTS

| | | | |
|---|---|---|---|
| 826759 | 4/1938 | France | 2/237 |
| 909605 | 5/1946 | France | 2/237 |
| 1189001 | 9/1959 | France | 2/237 |
| 912994 | 12/1962 | United Kingdom | 2/237 |

*Primary Examiner*—Werner H. Schroeder
*Assistant Examiner*—Mary A. Ellis
*Attorney, Agent, or Firm*—Milton S. Gerstein; Marvin N. Benn

[57] ABSTRACT

The present invention provides a waist band extender having a strip of substantially inelastic material and a single pair of complementary closure member mounted in spaced apart relationship for mating with complementary closure members normally incorporated into a garment's waist band for temporary use in extending such waist band without alterations, and for leaving such garment in normal state upon removal. Such extender may include means for holding a zipper of a garment together with the extender so as to provide security of closing where needed.

The present invention also provides a waist band extended garment of wearing apparel comprising in combination a garment having a permanent waist band integrated with lower reaches of the garment which waist band is extended by means of an extender described above.

3 Claims, 6 Drawing Figures

FIG. 1
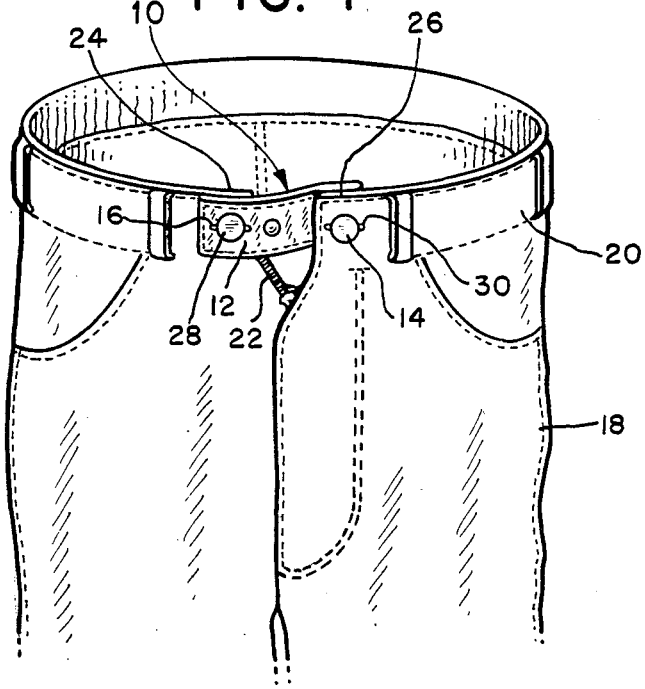
FIG. 4
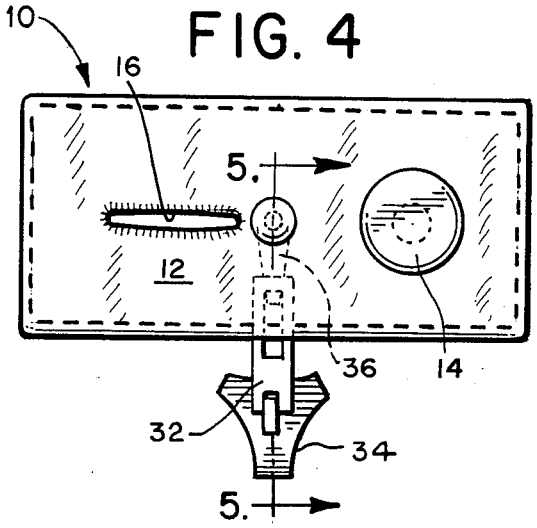
FIG. 6
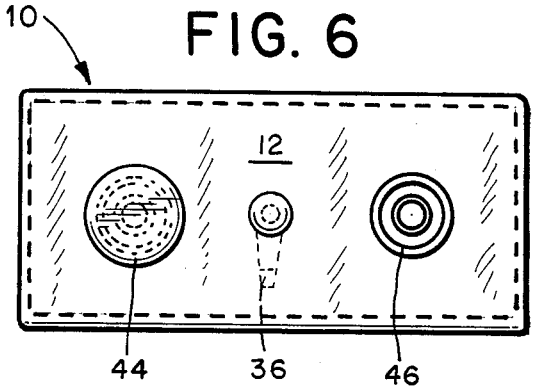
FIG. 5
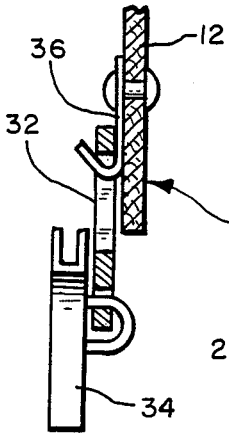
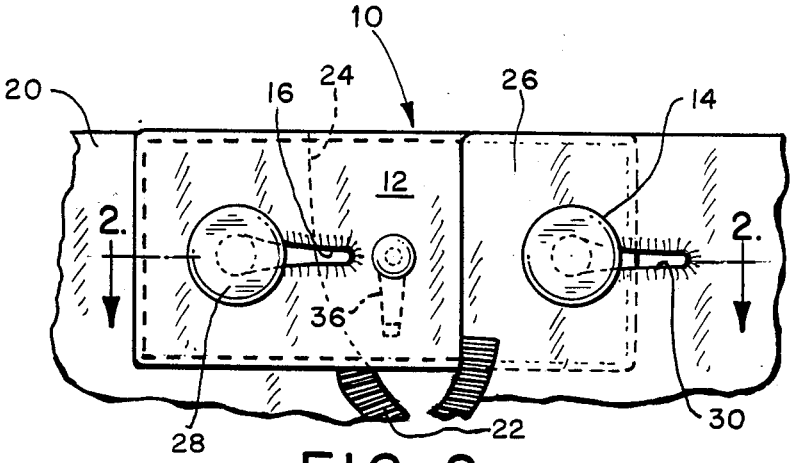
FIG. 2
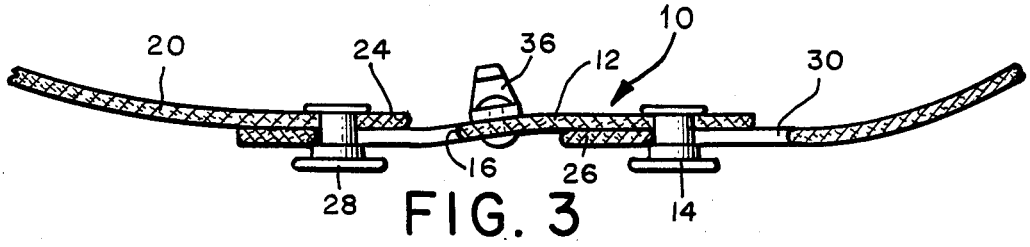
FIG. 3

WAIST BAND EXTENDER

This application is a continuation, of application Ser. No. 547,202, filed Oct. 31, 1983, now abandoned.

TECHNICAL FIELD OF THE INVENTION

The present invention is in the technical field of wearing apparel, and more particularly the field of waist band adjusters.

BACKGROUND OF THE INVENTION

In the wearing apparel field, a wide variety of clothing is designed so that the portion encircling the wearer's waist fits snugly. In articles such as jeans, skirts, trousers and the like, where the article of clothing reaches up to and terminates about the waist, the waist encircling portion is generally provided with means for drawing such portion from a loose to a close fit and securing same.

When reasonably close waist line fit is desired in a garment, difficulties arise due to body dimension variations, both from person to person in the general population, and for a given person temporary changes as to waist line. One often either sacrifices close fit or comfort.

Various adjustable features for waist lines have been previously devised. For instance, garments have been made with permanently joined waist bands of excess girth, which are gathered to smaller dimensions by elastic material encased within the waist band. Such "continuously" adjustable waist bands, however, are often deemed unsuitable due to their gathered appearance.

A variation of the elastic waist band is described in U.S. Pat. No. 1,174,976, as a removable elastic strip which is attached to an inelastic permanent waist band to draw it in closer. Such strip is encased in a sheath which in turn is stitched to the permanent band. The strip is provided with a plurality of button holes for attachment to a pair of buttons on the band. Selection of the button holes determines the extent the band will be shortened.

Another method of providing adjustability that has been devised previously is to provide, for a center-opening waist band, a plurality of alternative closure members on one or the other or both ends of the oermanent waist band, such as is disclosed in U.S. Pat. Nos. 570,317, 4,164,004, and 853,993.

A further variation, again for a center-opening band, combines an elastic tab that can be stretched to meet a plurality of alternative closure members as is described in U.S. Pat. No. 920,115.

Such adjusting means require additional elements to be incorporated into the garment at manufacture or alterations to the garment after manufacture, and in many instances the stylish appearance of a garment as to the area around the waist band is lost due to these additional elements and/or alterations.

For many wearers, a means for occasionally and temporarily adjusting a "styled to fit" garment in order to loosen the waist band is desired. Such a means, if adaptable to any conventional means for closing waist bands, would permit practically unlimited choice as to purchasing jeans, skirts, trousers and the like in a size providing the desired fit, which then may occasionally be adjusted to loosen the fit for comfort when required. It is further desired that such means require no permanent alteration to the garment itself so as to retain its normal stylish appearance when the need for waist band loosening passes.

For some wearers, a means for loosening the waist band of ready-to-wear clothing is necessary generally due to size problems. For such wearers, it is often desired that such a loosening means be relatively inexpensive and avoid costly alterations. Again, if such means be adaptable to any conventional means for closinq waist bands, the choice in clothing selection becomes almost unlimited. Further if the means is detachable, one can avoid purchasing such separate means for each and every garment requiring same.

It is an object of the present invention to provide a means for extending the waist band of a garment with normal closure means. It is an object to provide such means which can be used as a temporary measure and requires no alteration of the garment itself. It is an object to provide such means which, in use, permits security of closing. These and other objects will become apparent from the description of the invention given below.

DISCLOSURE OF THE INVENTION

The foregoing and other objects of the invention are provided by a waist band extender comprising a substantially inelastic band of material on which is positioned a pair of complementary closure members disposed in spaced-apart relationship. For instance, for extending the waist band of a pair of jeans normally closed by means of a button hole and button, the extender would include like closure members, i.e., a button and a button hole. The button on the band would be mated with the button hole on the jeans. The button hole on the band would be mated with the button on the jeans. The waist band of the jeans would thusly be extended by the distance between the closure members on the band.

The present invention also provides means for additionally securing closure of the garment by means for holding the tab of a zipper up to the waist band.

BRIEF DESCRIPTION OF THE DRAWINGS

FIG. 1 is a perspective view showing a waist band extender embodying features of the present invention;

FIG. 2 is a closer view of the waist band extender of FIG. 1;

FIG. 3 is a cross sectional view of the waist band extender of FIG. 1 taken along line 2 of FIG. 2;

FIG. 4 is a view of a waist band extender embodying features of the present invention;

FIG. 5 is a cross sectional view of the waist band extender of FIG. 4 taken along line 5 of FIG. 4; and FIG. 6 is a waist band extender embodying features of the present invention.

PREFERRED EMBODIMENTS OF THE INVENTION

Referring initially to FIG. 1, the present invention is a waist band extender, designated by the reference numeral 10, comprising a band or strip 12 having at one end a button 14 and at the other end a button hole 16. This extender 10 is shown in use adjusting a pair of jeans 18 at its waist band 20.

These jeans 18 typify such kind of garment formed with a permanent waist band 20 incorporated into the garment and forming an upper border therefor. The waist band 20 is an elongated piece of material, preferably a substantially inelastic material, which generally is the same material as the rest of the garment, here the jeans 18, possibly with some facing material encased therein to impart a greater rigidity than desired for the rest of the garment. The lower reaches of the jeans 18 are sewn together with the waist band 20 in such manner that the band 20, when fastened, is of smaller circumference than the other proximate portions of the jeans 18. The upper portion of the jeans 18 is drawn to a close fit first by means of a zipper 22, as shown, or possibly other means such as a series of snaps along the front flap. The zipper 22 is disposed perpendicularly to the lenqth of the waist band 20, ending approximately below the joining of the first and second ends 24, 26 of the waist band 20.

About the first end 24 of the band 20 is mounted a first closure member, a button 28, and about the second end 26 is a second and complementary closure member, the button hole 30. The button 28 and the button hole 30 would normally be mated together to close the band 20. Such closure, upon correct fitting, would fit the band 20 comfortably close to the waist line of the wearer.

As shown in FIGS. 1, 2, and 3, the girth of the waist band 20 is extended by the waist band extender 10 when its button 14 is mated to the button hole 30 of the jeans's waist band 20, and its button hole 16 is mated to the jeans's button 28, the strip 12 of the waist band extender 10 extending from a point in front of the band's first end 24 to a point behind the band's second end 26, bridging the gap between these ends 24, 26.

Such extension is achieved without any alteration on the conventional pair of jeans 18. The waist band extender 10 itself having complementary closure members utilizes the closure members normally found on a standard garment and utilizes them without any alternation thereto. Hence, upon removal of the extender 10, the jeans 18 can be worn in normal fashion without any change in their appearance.

In FIGS. 4 and 5 is shown a preferred embodiment of the invention, the waist band extender 10 as described above further including a means of retaining the zipper 22 in closed position. A typical zipper such as the zipper 22 shown has a tab 32 moveably mounted on the zipper head 34. This tab 32, when positioned with its free end down towards and adjacent to the locked zipper teeth (not shown) locks the zipper 22 against downward movement of the zipper head 34. In some instances, when the first and second ends 24, 26 of the waist band 20 are spaced apart during use of the waist band extender 10, the spreading of some of the zipper teeth above the zipper head 34 may place undue stress on the normal zipper locking mechanism, making that mechanism insecure. For such instances, a means for linking the zipper tab 32, and thus the zipper head 34, to the waist band extender 10 is provided in the form of a hook means 36 mounted on the waist band extender 10. Such hook means 36 is preferably mounted on the rear side of the extender 10 so that its lowest reach is positioned above the bottom edge of the extender 10, and faces inwardly forward the body of the wearer.

In FIG. 6 is shown another embodiment of the invention, a waist band extender 10 on which the complementary closure members are a female and a male snap elements 44, 46 for use with garments which have snap closures. The use is similar to that described above. The female snap closure member 44 would be mated with the male snap closure member on the garment, and the male snap closure member 46 of the extender 10 would be mated with the female snap closure member on the garment.

In preferred embodiment the center points of the complementary closure members on the waist band extender 10 are from about 0.5 to about 1.0 inches apart or less. In further preferred embodiment, the width of the extender 10 approximates the width of the garment's own waist band and is of at least similar color and material so as to both blend in with garment and not protrude beyond the normal edges of the garment's waist band.

Further, in normal use the closure members seen when a garment is worn are typically decorative pieces. For instance, for button/button hole type assemblies, one sees the button and buttons so seen are decorative. For snap assemblies, one sees the outer face of the female element and that is typically formed to be decorative. When the waist band extender 10 is used, a pair of such decorative elements is presented to the viewer, givinq an ornamental appearance.

Matching a waist band width and material or decorative closure element is not difficult with standardized garments such as jeans and the like. Further, when such garments are worn with a belt or overhanging top, the waist band extender 10 would not be seen at all.

The present invention is not limited to the embodiments set forth in this specification and is as broad as that defined in the following claims.

INDUSTRIAL APPLICABILITY OF THE INVENTION

The waist band extender of the present invention has commercial use in the wearing apparel industry, particularly in that segment directed to utilitarian wearing apparel accessories.

I claim:

1. A waist band extended garment of wearing apparel comprising:

a permanent waist band of substantially inelastic material integrated with lower reaches of said garment;

a pair of complementary closure members mounted on said waist band, the first of said waist band closure members being mounted at a first end of said waist band, and the second of said waist band closure member being mounted at a second end of said waist band;

a waist band extender comprising a strip and a first and second extender closure members;

wherein said first extender closure member is mated to said first waist band closure member and said second extender closure member is mated to said second waist band closure member, which matings are by normal function of said closure members;

said strip extending from a point in front of the first end of said waist band to a point behind the second end of said waist band;

a zipper mounted below said waste band wherein said zipper terminates in close proximity to said first and second ends of said waist band, said zipper having a zipper head ;

zipper head holding means comprising a hook mounted on said strip between said first and second extender closure members, said hook being mounted to said strip on the rear surface thereof such that said hook is not normally seen during use, said hook mating with said zipper head to hold said zipper in its upwardmost extension during use;

said hook of said zipper head holding means having a first upper portion fixedly connected to said rear surface of said strip for non-removal attachment, and a second lower portion having a bent shape for receiving in mating relationship said zipper head, the lowermost point of said second lower portion being above the lowermost edge surface of said strip such that said hook is not seen during normal usage; said second lower bent portion projecting away from said rear surface of said strip and away from the front surface of said strip, so that said second bend portion during usage normally prevents accidental lowering of said zipper.

2. A waist band extender for pants, and other wearing apparel having a zipper comprising a zipper head for moving the zipper up and down and for locking the zipper in place, comprising, in combination:

a strip, and a first and a second extender closure member;

said first extender closure member being connectable to a waist band of a pair of pants, and the like, at a first waist band closure member thereof, and said second extender closure member being connectable to the waist band at a second waist band closure member thereof;

zipper head holding means comprising a hook mounted on said strip between said first and second extender closure members, said hook being mounted to said strip on the rear surface thereof such that said hook is not normally seen during use, said hook mating with the zipper head to hold the zipper of the pants in its upward-most extension during use;

said hook of said zipper head holding means having a first upper portion fixedly connected to said rear surface of said strip for non-removal attachment, and a second lower portion having a bent shape for receiving in mating relationship the zipper head, the lowermost point of said second lower portion being above the lowermost edge surface of said strip such that said hook is not seen during normal usage; said second lower bent portion projecting away from said rear surface of said strip and away from the front surface of said strip, so that said second bent portion during usage normally prevents accidental lowering of the zipper.

3. The waist band extended garment according to claim 2, wherein said strip has a width substantially equal to the width of said waist band so that said strip is similar in appearance thereto.

* * * * *